United States Patent [19]

de Paul et al.

[11] Patent Number: 4,471,910

[45] Date of Patent: Sep. 18, 1984

[54] DIFFUSER WITH THROUGH-THE-WALL BLEEDING

[75] Inventors: Michel V. de Paul, Saint-Leonard; Gilbert Riollet, Paris, both of France

[73] Assignee: Alsthom-Atlantique, Paris, France

[21] Appl. No.: 337,890

[22] Filed: Jan. 7, 1982

[30] Foreign Application Priority Data

Jan. 8, 1981 [FR] France ..... 81 00210

[51] Int. Cl.[3] ..... F04D 29/44

[52] U.S. Cl. ..... 239/124; 415/DIG. 1

[58] Field of Search ..... 239/265.11, 589, 124; 415/DIG. 1

[56] References Cited

U.S. PATENT DOCUMENTS 4,214,452 7/1980 Riollet et al. ..... 415/DIG. 1 X

FOREIGN PATENT DOCUMENTS 992353 10/1951 France .

1000767 8/1965 United Kingdom .

1024328 3/1966 United Kingdom .

*Primary Examiner*—Andres Kashnikow

*Attorney, Agent, or Firm*—Sughrue, Mion, Zinn, Macpeak and Seas

[57] ABSTRACT

The diffuser is symmetrical about an axis AA' and has a flared outer wall (2,3) going from an axial inlet to an outlet. The outer wall is divided into an upstream portion (2) and a downstream portion (3) by a circular bleed slot (1) disposed symmetrically about the axis. The profile of the outer wall is such that, in operation, the direction of fluid flow along the outer wall is from the inlet towards the outlet, both over the upstream portion, and over the downstream portion. Further, it is so arranged that the pressure gradient measured at the surface of the wall and along the direction of fluid flow is negative upstream from the bleed slot and positive downstream therefrom. This ensures that only a small percentage of the fluid flow needs to be bled off to achieve desirable flow conditions, thereby providing good diffuser efficiency.

5 Claims, 9 Drawing Figures

DIFFUSER WITH THROUGH-THE-WALL BLEEDING

FIELD OF THE INVENTION

The present invention relates to a diffuser that is symmetrical about an axis AA' with a substantially axial inlet, and a flared outer wall leading from said inlet to an outlet. A proportion of the fluid flow inside the diffuser is bled off through said flared wall via a circular slot disposed symmetrically about the axis.

BACKGROUND OF THE INVENTION

Such a diffuser is described in British Pat. No. 1,024,328.

In said prior diffuser, the fluid flows along the outer wall in the general inlet-to-outlet direction over the portion of the wall upstream from the bleed slot, but the flow downstream from the slot along said outer wall is reversed, i.e. it is from the outlet towards the bleed slot.

This causes separation downstream from the slot.

Preferred embodiments of the present invention enable such separation to be avoided.

SUMMARY OF THE INVENTION

The present invention provides a diffuser with through the wall bleeding, said diffuser being symmetrical about an axis AA', and comprising a fluid inlet on said axis, a flared outer wall leading from said fluid inlet to a fluid outlet, and a circular bleed slot arranged symmetrically about said axis AA' in the flared portion of said outer wall, thereby dividing said outer wall into an upstream portion and a downstream portion. Said flared outer wall has a profile such that, in operation, the direction of fluid flow along the surface of said wall is from said inlet towards said outlet, both over the upstream portion of said wall and over he downstream portion of said wall, and wherein the pressure gradient along said wall in said direction of fluid flow and as measured at the surface of said wall is negative upstream from said slot and positive downstream therefrom.

The existance of recompression downstream from the slot opposes reverse flow along the downstream portion of the outer wall.

Diffusers are also known in which the pressure gradient on both sides of the slot is nil.

An example of such a diffuser is described in British Pat. No. 1,000,767.

To a large extent, separation of the boundary layer can be avoided in such diffusers by suction through the bleed slot. However, experiments have shown that there exists a large range of bleed ratios (i.e. the quantity of fluid bled off divided by the total quantity of fluid entering the diffuser) for which operation is not stable.

This has led to such diffusers being operated at a fairly high bleed ratio (10% or more) which considerably limits their use in practice.

It is possible to avoid boundary layer separation both upstream and downstream of the slot at a lower bleed ratio by using said outer wall profile that gives rise to a negative pressure gradient along the outer wall, upstream from the bleed slot, and a positive pressure gradient along the outer wall, downstream from the bleed slot.

Advantageously, said slot has an entry angle lying between 100° and 120° as measured from the flow direction along the axis AA'.

This reduces the minimum bleed ratio necessary for effective operation.

In a preferred embodiment of the invention said slot has an inlet width $b_{opt}$ substantially equal to:

$$\frac{1}{\frac{1}{L} - \frac{1}{R_1} + \sqrt{\frac{1}{R_1^2} + \frac{1}{L^2}}}$$

where $L = X \cdot (S_0/2\pi r) \cdot (V_0/V_1)$, and:

X is the bleed ratio, i.e. the ratio of the bleed flow through the slot divided by the total inlet flow to the diffuser;

$S_0$ is the inlet cross section of the diffuser;

r is the radial distance between the slot and the axis;

$V_0$ is the average fluid speed in the inlet cross section of the diffuser;

$V_1$ is the fluid speed over the upstream portion of the outer wall at the inlet to the slot; and $R_1$ is the radius of curvature of the upstream portion of the outer wall at the inlet to the slot.

The optimum slot width is close to the value given by the equation. If the slot is too narrow, then its chances of capturing possible separation zones upstream from the slot are reduced, while losses at the slot are increased for constant bleed ratio since the entry speed into the slot must be increased. On the other hand, if the slot is too wide, the entry speed into the slot for given bleed ratio becomes too low thereby favouring separation upstream from the slot, while increasing the speed against the leading edge of the downstream portion of the wall, thereby thickening the boundary layer, maybe up to the point of separation.

It is also preferred for the leading edge of the downstream portion of the outer wall to be offset relative to the trailing edge of the upstream portion of the outer wall by a distance equal to or slightly greater than:

$$\frac{1}{\frac{1}{L} - \frac{1}{R_1} + \sqrt{\frac{1}{R_1^2} + \frac{1}{L^2}}}$$

where $L = X \cdot (S_0/2\pi r) \cdot (V_0/V_1)$ and;

X, $S_0$, r, $V_1$, and $R_1$ are defined as above, and said offset is defined as the distance between an upstream plane perpendicular to the axis and tangential to the trailing edge of the downstream portion of the outer wall, and a downstream plane perpendicular to the axis and passing through the centre of the circular cross section of the tip of the leading edge of the downstream portion of the outer wall.

The invention is particularly effective when the outlet angle from the diffuser is about 90°, i.e. when the diffuser is a radial diffuser.

This is because the deflection of the fluid from axial flow to radial flow adds to the recompression effect thereby increasing the tendancy for the boundary layer to separate.

An embodiment of the invention is described by way of example with reference to the accompanying drawings.

DESCRIPTION OF THE PREFERRED EMBODIMENT

Figure 1:
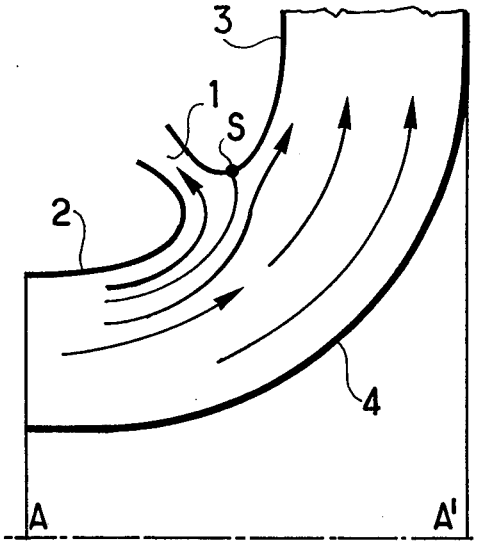
PRIOR ART FIG. 1
FIG. 1 is a schematic section which shows a first, or desired type of flow in a diffuser having an axial inlet an a bleed slot in the flared portion of the outer wall.
Figure 2:
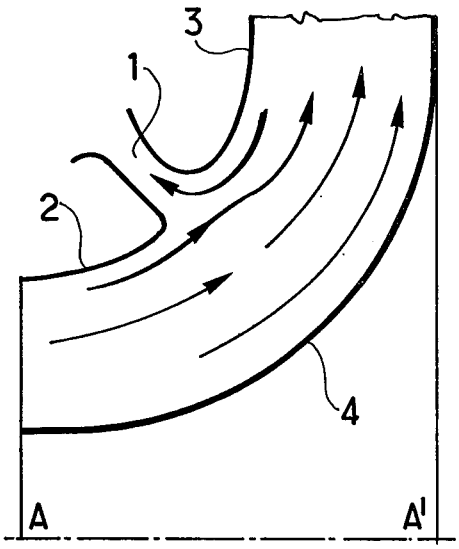
PRIOR ART FIG. 2
FIG. 2 is a similar schematic view to that of FIG. 1 which shows a second, or undesired type of flow in the same diffuser as shown in FIG. 1.

FIGS. 1 and 2 show a conventional axial inlet diffuser having a flared outer wall divided by a slot 1 into an upstream portion 2 and a downstream portion 3. The diffuser also has an inner wall 4. The diffuser is symmetrical about an axis AA', and the profile of the outer wall 2, 3 is such that the pressure gradient upstream and downstream from the slot is nill.

It has been observed that two different types of flow are possible for a given bleed ratio X (quantity of fluid bled off through the slot 3 divided by the quantity of fluid entering the diffuser) over a fairly wide range of values of X.

FIG. 1 shows the desired normal flow. The boundary layer upstream from the slot 1 along the upstream portion 2 of the outer wall is sucked into the slot 1.

This ensures that the flow does not separate downstream from the slot.

In FIG. 2, a reverse flow is estabished along the outer wall portion 3 downstream from the slot 1. Once such a flow is established, it is impossible to recompress the fluid in the diffuser.

Figure 5:
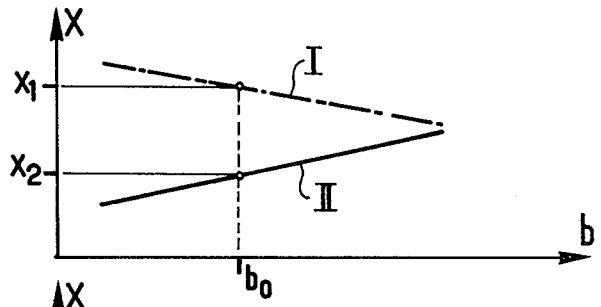
FIGS. 5 to 8 are graphs showing how the bleed ratio varies as a function of slot width.

FIG. 5 is a graph showing the bleed ratio X as a function of the width b of the slot 1.

A first, dot-dashed curve (I) shows minimum values of X as a function of b to be sure of establishing the flow pattern shown in FIG. 1, while a second, continuous, curve (II) shows maximum values of X as a function of b to be sure of establishing the flow pattern shown in FIG. 2. For any given value $b_0$ of b there are two corresponding values of X: $X_1$ on the curve I and $X_2$ on the curve II. For X less than or equal to $X_2$ the FIG. 2 flow pattern will always occur.

For X lying in between $X_2$ and $X_1$, either flow pattern may be established, while for X greater than or equal to $X_1$, the flow pattern of FIG. 1 will always occur.

It follows that it is advisable to use a bleed ratio X which is equal to or greater than the value defned by the first curve I.

Figure 3:
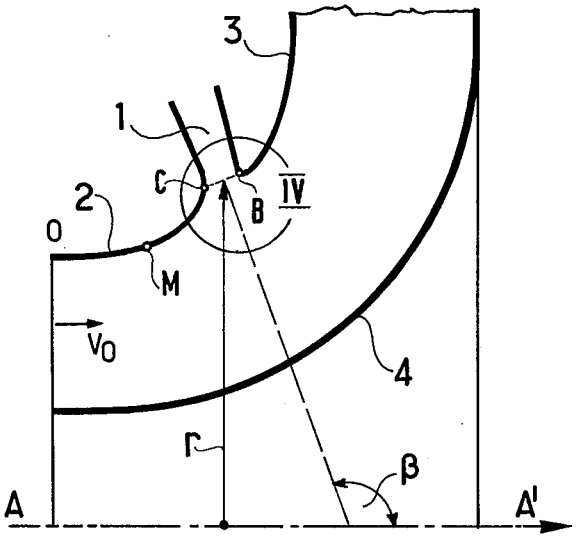
FIG. 3 is a cross section through a diffuser in accordance with the present invention.

FIG. 3 shows a diffuser in accordance with the invention. It is symmetrical about the axis AA'. The outer wall has a slot 1 dividing it into an upstream portion 2 and a downstream portion 3. The profile of the outer wall is such that the pressure gradient measured along its surface in the direction of fluid flow is negative upstream from the slot and positive downstream therefrom.

The inlet cross section of the diffuser is $S_0$ and the average speed of fluid flow at this point is $V_0$.

The slot 1 is circular and is also symmetrical about the axis AA'. Its inlet BC is of width b and the speed of fluid flow along the wall 2 at point C of the inlet to the slot 1 is $V_1$. The slot 1 flares slightly downstream from its inlet.

The slot 1 is at an angle $\beta$ to the axis AA'.

Figure 6:
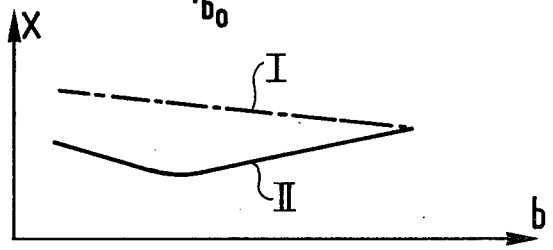

FIG. 6 shows the curves I and II for a diffuser in accordance with the invention, i.e. in which the profile of the outer wall is such that the pressure gradient in the direction of fluid flow measured at its surface is negative upstream from the slot and positive downstream therefrom.

Curves I and II are both lower than in FIG. 5, and it is therefore possible to obtain proper operation at a considerably lower bleed ratio for any given value of slot width b.

The pressure along the upstream wall portion 2 decreases progressively from the inlet to the diffuser up to the slot 1, whereby the fluid is accelerated and the boundary layer will be kept in a state far removed from separation. Nonetheless, too high a speed at the inlet to the diffuser must be avoided since that would lead high losses in the slot, and possibly to compressibility problems. Depending on the freedom of design in choosing the wall profile, the chosen slot entry speed will lie in the range 15% to 40% faster than the speed of entry into the diffuser.

The profile of the downstream wall portion 3 reduces the risk of the FIG. 2 flow pattern forming.

The variation of pressure along the inner wall 4 of the diffuser depends on the deflection required for a given diffuser.

Figure 7:
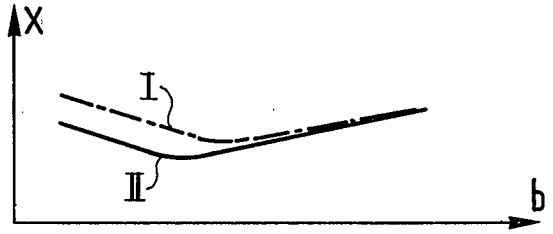

The inlet angle $\beta$ of the slot 1 relative to the axis AA' is chosen to lie in the range 100° to 120°, thereby reducing the minimum bleed ratios of curve I (see FIG. 7).

The width of the slot is an important parameter. If the slot is too narrow, there is less chance of capturing a boundary layer that has become separated from the upstream wall portion 2. Also, slot losses are increased (for constant bleed ratio). If the slot is too wide, separation along the upstream wall portion 2 is encouraged, and further, the stop point S (i.e. where the flow speed is nil) may move a small way into the slot, which leads to excessively high flow speeds going round the leading edge following the point S on the upstream wall portion 3. This leads to the boundary layer on the wall portion 3 being increased in thickness, hence increasing the danger of its becoming separated with consequent increase in diffuser losses.

The optimum width $b_{opt}$ is close to:

$$\frac{1}{\frac{1}{L} - \frac{1}{R_1} + \sqrt{\frac{1}{R_1^2} + \frac{1}{L^2}}}$$

where $L = X \cdot (S_0/2\pi r) \cdot (V_0/V_1)$

The ratio $V_1/V_0$ is easy to measure by placing a first static pressure probe in the slot inlet (p1), a second in the diffuser inlet plane (p0), and pitot tube in said inlet plane to measure the stop pessure (p0*). The ratio $V_1/V_0$ is then equal to:

$$\sqrt{\frac{P_o^* - P_1}{P_o^* - P_0}}$$

Figure 9:
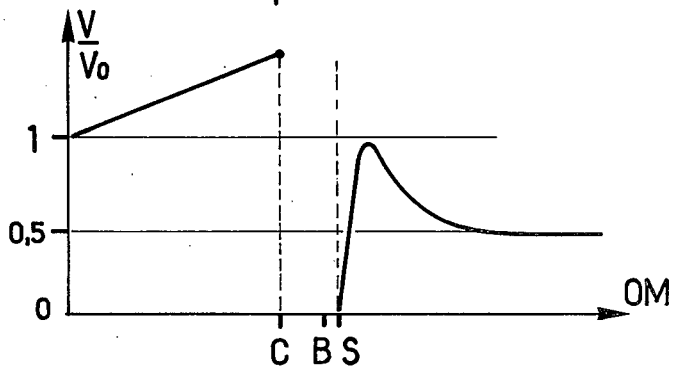
FIG. 9 is a graph showing the variation of fluid speed along the outer wall of the diffuser.

FIG. 9 shows the variation in the ratio $V/V_0$ (where V is the speed at a point M on the upstream or the downstream wall portion 2, 3) as a function of the curvilinear distance along the curve 0M, where 0 is the point on the upstream wall portion 2 at the inlet to the diffuser. As M goes from 0 to C, the ratio $V/V_0$ increases regularly, At S the speed is nil, and thereafter the ratio rises rapidly before dropping to a limit value.

Figure 4:
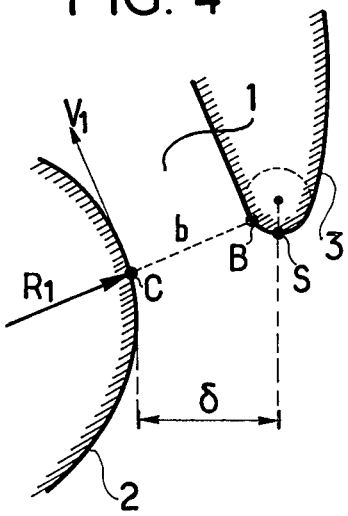
FIG. 4 is a cross section through the slot entrance of FIG. 3, showing the region marked IV, to a larger scale.

The downstream wall portion 3 is offset in the flow direction (see FIG. 4) by a distance $\delta$ defined as the distance between two planes perpendicular to the axis AA'; the first, or upstream plane is the plane tangential to the upstream wall portion 2, and the second, or downstream plane is the plane passing through the centre of the circular cross section of the upstream tip of the downstream wall portion 3. The offset distance $\delta$ is preferably equal to or slightly greater than the optimum slot width $b_{opt}$ mentioned earlier.

Figure 8:
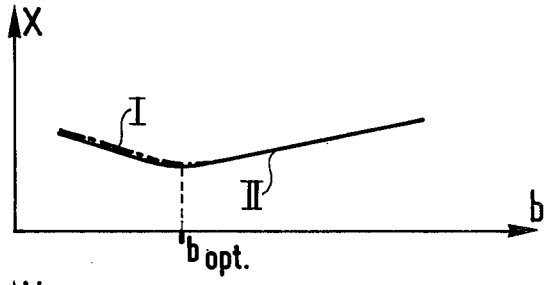

When the offset is chosen to be slightly greater than $b_{opt}$, and the conditions imposed by the curves in FIG. 7 are complied with, the curve I becomes practically the same as the curve II (see FIG. 8), with the minimum valve of said curves occurring when the width of the slot is equal or near to $b_{opt}$.

The profile of the leading edge of the downstream wall portion 3 is preferably chosen so that the radius of the cicular cross section of its upstream tip is equal to or greater than $b_{opt}/4$.

As can be seen from the graphs of FIGS. 5 to 8, a judicious choice of slot width, of slot outlet angle, and of downstream wall portion offset, can minimise the bleed ratio of the diffuser, thereby increasing its overall efficiency.

For a diffuser having an axial outlet as well as an axial inlet, the inner wall 4 will naturally be omitted.

We claim:

1. A diffuser with through the wall bleeding, said diffuser being symmetrical about an axis AA', and comprising a fluid inlet on said axis, a flared outer wall leading from said fluid inlet to a fluid outlet, and a circular bleed slot arranged symmetrically about said axis AA' in the flared portion of said outer wall, thereby dividing said outer wall into an upstream portion and a downstream portion, the improvement wherein said flared outer wall has a profile such that, in operation, the direction of fluid flow along the surface of said wall is from said inlet towards said outlet, both over the upstream portion of said wall and over the downstream portion of said wall, and wherein the pressure gradient along said wall in said direction of fluid flow and as measured at the surface of said wall is negative upstream from said slot and positive downstream therefrom.

2. A diffuser according to claim 1, wherein said slot has an entry angle $\beta$ lying between 100° and 120° as measured from the direction of flow along the axis AA'.

3. A diffuser according to claim 1 or 2, wherein said slot has an inlet width $b_{opt}$ substantially equal to:

$$\frac{1}{\frac{1}{L} - \frac{1}{R_1} + \sqrt{\frac{1}{R_1^2} + \frac{1}{L^2}}}$$

where $L = X \cdot (S_0/2\pi r) \cdot (V_0/V_1)$ and:

X is the bleed ratio, i.e. the ratio of the bleed flow through the slot divided by the total inlet flow to the diffuser;

$S_0$ is the inlet cross section of the diffuser;

r is the radial distance between the slot and the axis;

$V_0$ is the average fluid speed in the inlet cross section of the diffuser;

$V_1$ is the fluid speed over the upstream portion of the outer wall at the inlet to the slot; and $R_1$ is the radius of curvature of the upstream portion of the outer wall at the inlet to the slot.

4. A diffuser according to claim 1 or 3, wherein the downstream portion of the outer wall has a leading edge which is offset relative to the trailing edge of the upstream portion of the outer wall by a distance equal to or slightly greater than:

$$\frac{1}{\frac{1}{L} - \frac{1}{R_1} + \sqrt{\frac{1}{R_1^2} + \frac{1}{L^2}}}$$

where $L = X \cdot (X_0/2\pi r) \cdot V_0/V_1$ and:

X is the bleed ratio, i.e. the ratio of the bleed flow through the slot divided by the total inlet flow to the diffuser;

$S_0$ is the inlet cross section of the diffuser;

$V_0$ is the average fluid speed in the inlet cross section of the diffuser;

r is the radial distance between the slot and the axis;

$V_1$ is the fluid speed over the upstream portion of the outer wall at the inlet to the slot; and $R_1$ is the radius of curvature of the upstream portion of the outer wall at the inlet to the slot; and wherein said offset is defined as the distance between an upstream plane perpendicular to the axis and tangential to the trailing edge of the downstream portion of the outer wall, and a downstream plane perpendicular to the axis and passing through the centre of the circular cross section of the tip of the leading edge of the downstream portion of the outer wall.

5. A diffuser according to claim 1 or 2, wherein the outlet angle from the diffuser is about 90°.

* * * * *